US006823161B2

(12) United States Patent
Cho et al.

(10) Patent No.: US 6,823,161 B2
(45) Date of Patent: Nov. 23, 2004

(54) DEVELOPER OF ELECTROPHOTOGRAPHIC IMAGE FORMING SYSTEM

(75) Inventors: Jun-hee Cho, Yongin-si (KR); Geun-yong Park, Suwon-si (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/153,227

(22) Filed: May 23, 2002

(65) Prior Publication Data

US 2003/0129004 A1 Jul. 10, 2003

(30) Foreign Application Priority Data

Jan. 4, 2002 (KR) ..... 2002-433

(51) Int. Cl.[7] ..... G03G 15/10
(52) U.S. Cl. ..... 399/237; 399/340
(58) Field of Search ..... 399/57, 58, 237, 399/238, 239, 240; 366/241, 257, 252

(56) References Cited

U.S. PATENT DOCUMENTS 3,392,708 A * 7/1968 Hunstiger ..... 399/238
3,561,400 A * 2/1971 Smitzer et al. ..... 399/239
3,851,964 A * 12/1974 Smith et al.
3,876,282 A * 4/1975 Schon et al. ..... 399/238
4,262,998 A * 4/1981 Kuehnle et al.
6,249,655 B1 * 6/2001 Baek et al. ..... 399/237
6,370,348 B1 * 4/2002 Okano et al. ..... 399/256
6,480,684 B2 * 11/2002 Shindo ..... 399/57

FOREIGN PATENT DOCUMENTS

JP 63074083 A * 4/1988 ..... G03G/15/10

* cited by examiner

*Primary Examiner*—Arthur T. Grimley
*Assistant Examiner*—Ryan Gleitz
(74) *Attorney, Agent, or Firm*—Sughrue Mion, PLLC

(57) ABSTRACT

A developer, for an electrophotographic image forming system, includes a developer container for storing developing solution, a developing roller which is partially soaked in the developing solution stored in the developer container and installed to rotate in an opposite direction of a photosensitive medium, a cleaning roller, which is soaked in the developing solution, is installed to rotate opposite to the developing roller and removes the developing solution remaining on the surface of the developing roller, and a developing solution agitator, which agitates the developing solution, and thereby keeps the developing solution in uniform concentration. The efficiency of circulation of the developing solution can be increased by upward and downward circulating the developing solution with high concentration stored in the developer container, and the developing solution can be kept in uniform concentration by preventing the developing solution with high concentration from being deposited at the bottom of the developer container.

9 Claims, 3 Drawing Sheets

DEVELOPER OF ELECTROPHOTOGRAPHIC IMAGE FORMING SYSTEM

BACKGROUND OF THE INVENTION

1. Field of the Invention

The present invention relates to an electrophotographic image forming system and, more particularly, to a developer having a developing solution agitator for keeping the developing solution stored in a developer container in uniform concentration.

2. Description of the Related Art

In general, an electrophotographic image forming system is a system in which an electrostatic latent image is formed on a photosensitive medium and then, the electrostatic latent image is developed with a toner having a predetermined color, and a developed image is transferred onto a paper, and thereby, a desired image is obtained.

The electrophotographic image forming system includes a dry-type electrophotographic image forming system and a wet-type electrophotographic image forming system according to a toner. A toner in a powder state is used in the dry-type electrophotographic image forming system. On the other hand, liquid developing solution in which toner particles having a charge are dispersed into an insulating liquid carrier having a volatile component and mixed is used in the wet-type electrophotographic image forming system, and the wet-type electrophotographic image forming system can have print quality higher than the dry-type electrophotographic image forming system, and simultaneously, can prevent damage caused by harmful dust of a toner.

In general, a conventional wet-type electrophotographic image forming system includes a developer for coating an electrostatic latent image formed on a photosensitive medium with developing solution and developing the electrostatic latent image. The developer includes a developer container for storing developing solution, a developing roller of which part is soaked in the developing solution and which rotates while being in contact with a photosensitive medium and develops an electrostatic latent image, a deposit roller for coating the developing roller with the developing solution using a potential difference, and a cleaning roller which is installed to be soaked in the developing solution, for removing the developing solution stained on the developing roller after development.

The developing roller and the cleaning roller shake the developing solution stored in the developer container while rotating, and thereby the developing solution is kept in uniform concentration.

However, as the developing roller and the cleaning roller rotate, the developing solution stored in the developer container is shaken, and thereby there is a limitation in that the developing solution is kept in uniform concentration.

In particular, a toner deposited at the bottom of the developer container is not fully shaken even though the cleaning roller rotates, and thus, the amount of the toner deposited at the bottom of the developer container is increased, and thereby the developing solution cannot be kept in uniform concentration. As the amount of the toner deposited at the bottom of the developer container is increased, ink recovery is disturbed, and due to the solidification caused by the deposition of the liquid developing solution, the developer is damaged, and print quality is lowered.

SUMMARY OF THE INVENTION

To solve the above problems, it is an aspect of the present invention to provide a developer of an electrophotographic image forming system having a developing solution agitator for up and down agitating the developing solution with high concentration stored in a developer container and for keeping the developing solution in uniform concentration.

Accordingly, to achieve the above aspect, there is provided a developer of an electrophotographic image forming system. The developer includes a developer container for storing developing solution, a developing roller which is partially soaked in the developing solution that is stored in the developer container, the developing roller being installed to rotate in an opposite direction of a direction of a photosensitive medium, and a developing solution agitator which agitates the developing solution and thereby keeps the developing solution in a uniform concentration.

BRIEF DESCRIPTION OF THE DRAWINGS

The above aspect and advantages of the present invention will become more apparent by describing in detail an illustrative, non-limiting embodiment thereof with reference to the attached drawings, in which.

DETAILED DESCRIPTION OF AN ILLUSTRATIVE EMBODIMENT

Figure 1:
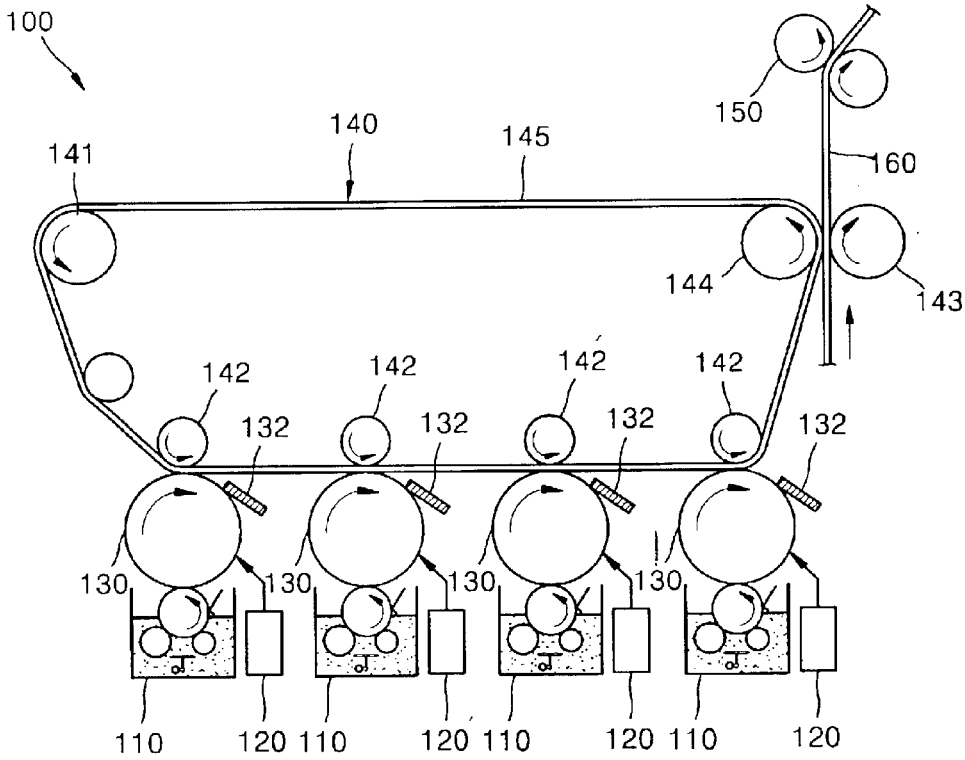
FIG. 1 is a schematic view of the structure of an electrophotographic image forming system adopting a developer according to the present invention.

FIG. 1 is a schematic view of the structure of an electrophotographic image forming system adopting a developer according to an illustrative, non-limiting embodiment of the present invention. Referring to FIG. 1, an electrophotographic image forming system 100 includes a developer 110, a light scanning unit 120, a transferring unit 140, and a fusing unit 150.

The light scanning unit 120 forms a predetermined electrostatic latent image on a photosensitive medium 130.

The developer 110 forms an image by coating the electrostatic latent image, which is formed on the photosensitive medium 130 by the light scanning unit 120 with developing solution having a predetermined color in which a toner in a powder state is mixed with a liquid carrier.

The transferring unit 140 transfers the image, which is transferred from the photosensitive medium 130 onto a transfer belt 145, which rotates while being supported by a driving roller 141, a paper transfer backup roller 144, and a plurality of transfer backup rollers 142, onto a paper 160 passing through a paper transfer roller 143 which is installed to be opposite to the paper transfer backup roller 144. The fusing unit 150 is installed on a discharging path of the paper 160 and heats the image, which is transferred passing through the paper transfer roller 143 and the paper transfer backup roller 144, on the paper 160 at a predetermined temperature, and thereby the image is adherently fused on the paper 160. The transferring unit 140 may perform a fusing function in the state where a predetermined heat source is connected to the paper transfer roller 143 or the paper transfer backup roller 144.

A scraper 132 is used to remove excess developing solution.

Figure 2:
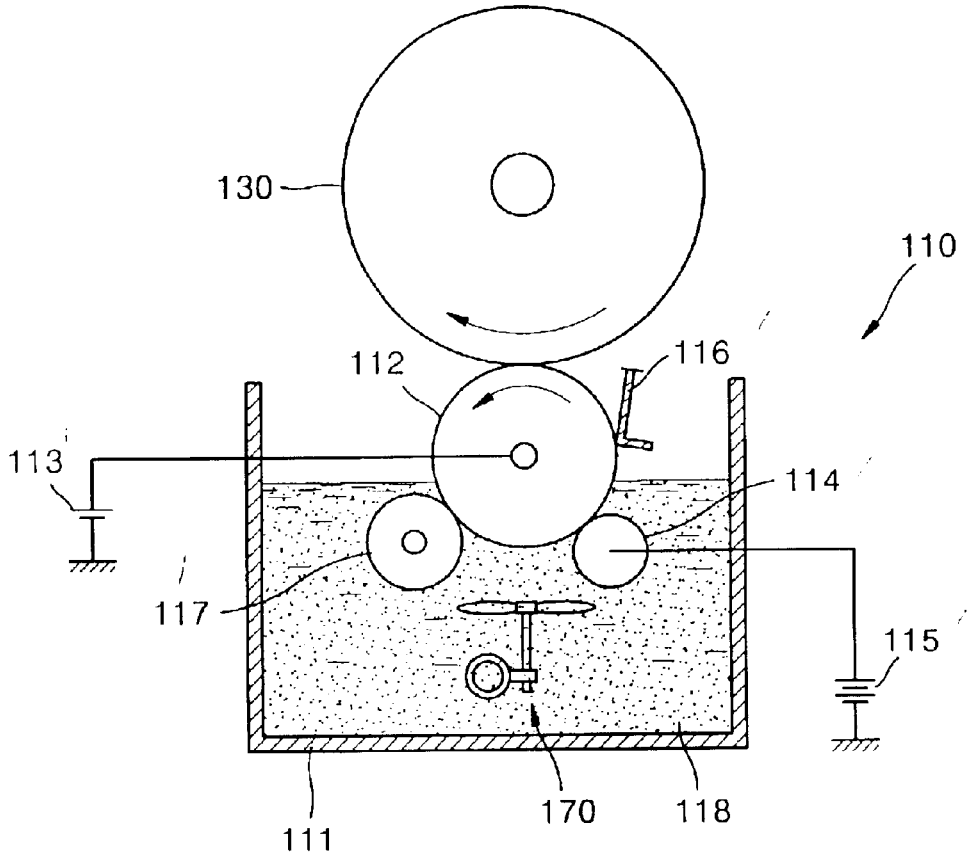
FIG. 2 is a schematic cross-sectional view of the structure of the developer shown in FIG. 1.

FIG. 2 is a schematic cross-sectional view of the structure of the developer shown in FIG. 1. Referring to FIG. 2, the developer 110 includes a developer container 111, a developing roller 112, a deposit roller 114, a metering device 116, a cleaning roller 117, and an agitator 170.

The developer container 111 stores developing solution 118, which is supplied through a predetermined connection path (not shown) from a developing solution tank (not shown). A predetermined pump (not shown) may be installed on the connection path so that the developing solution 118 is smoothly supplied to the developer container 111 from the developing solution tank.

The developing solution 118 used in the present invention has a high concentration of toner, but not more than 40%, and thus has a high viscosity so that the developing solution 118 may accumulate at a downside of the developer container 111 in a case where the developing solution 118 is not shaken for a long time.

A part of the developing roller 112 is soaked in the developing solution 118, which is stored in the developer container 111, and the developing roller 112 is connected to a developing power unit 113 installed outside the developer container 111, and thus has a predetermined voltage. Thus, the developing roller 112 rotates contacting the photosensitive medium 130 having a predetermined voltage and forms an image by coating the electrostatic latent image, which is formed on the photosensitive medium 130, with the developing solution 118 using a potential difference.

The deposit roller 114 is soaked in the developing solution 118 stored in the developer container 111 and is connected to a deposit power unit 115 installed outside the developer container 111, and thus has a predetermined voltage. The deposit roller 114 attaches the developing solution 118 onto the surface of the developing roller 112 by using a potential difference with the developing roller 112, which is connected to the developing power unit 113 and thus has a predetermined voltage.

The deposit roller 114 is separated from the developing roller 112 at a predetermined gap, as shown in FIG. 2, but may be in contact with the developing roller 112, fixed or installed to rotate.

The metering device 116 is installed to be adjacent to the developing roller 112 and cut the developing solution 118, which is attached to the developing roller 112 by the deposit roller 114, to a predetermined thickness, or regulates the % concentration of the developing solution 118. A metering blade or metering roller may be used as the metering device 116.

The cleaning roller 117 removes the residual developing solution 118 remaining on the developing roller 112 after the electrostatic latent image formed on the photosensitive medium 130 is developed, and is installed to rotate to be opposite to the developing roller 112 with being soaked in the developing solution 118.

Figure 3:
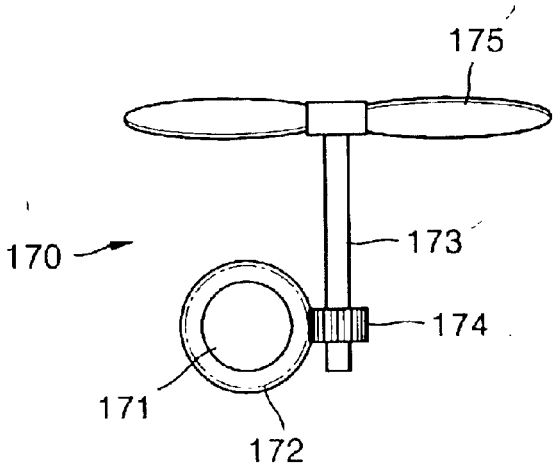
FIG. 3 is a view of a developing solution agitator shown in FIG. 2.
Figure 4:
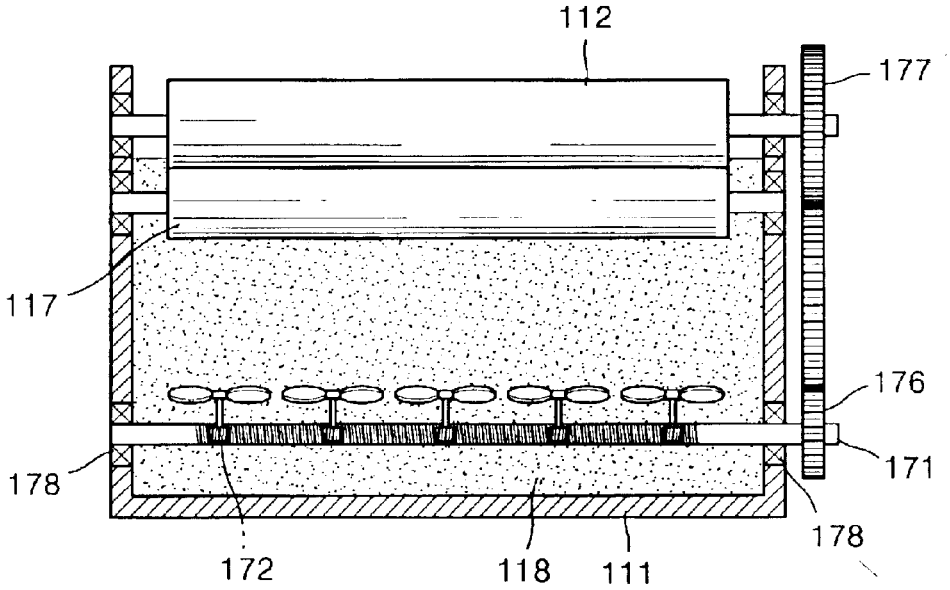
FIG. 4 illustrates the structure of power transmission of the developing solution agitator shown in FIG. 2.
Figure 5:
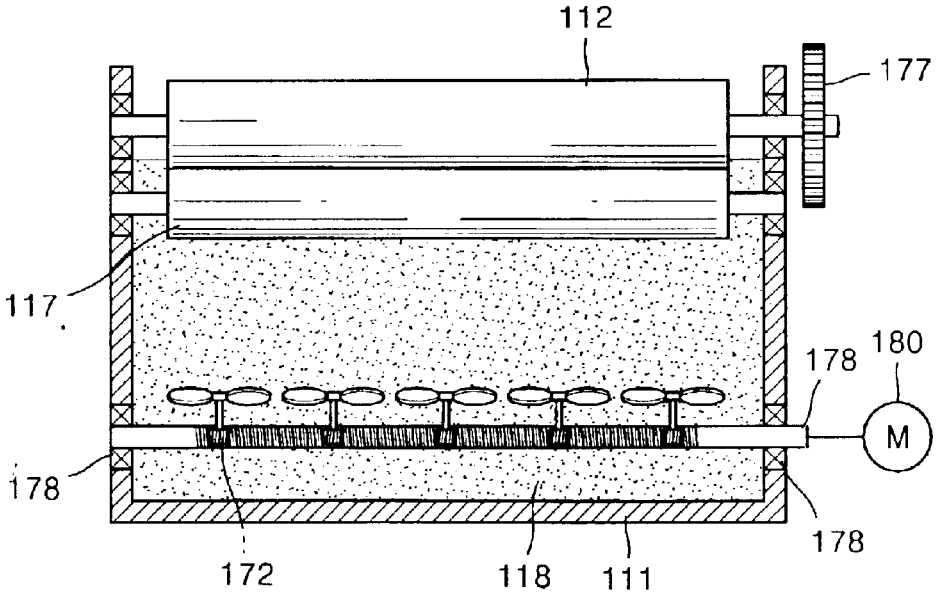
FIG. 5 illustrates another structure of power transmission of the developing solution agitator shown in FIG. 2.

FIG. 3 is a view of a developing solution agitator shown in FIG. 2, FIG. 4 illustrates the structure of power transmission of the developing solution agitator shown in FIG. 2, and FIG. 5 illustrates another structure of power transmission of the developing solution agitator shown in FIG. 2. In the drawings, the same reference numerals denote the same element having the same function.

Referring to FIGS. 3 through 5, the developing solution agitator 170 is installed to be soaked in the developing solution 118 at a downside of the developer container 111, and thus shakes the developing solution 118 to keep the developing solution 118 in uniform concentration, and includes a first shaft 171, a second shaft 173, and a propeller 175.

The first shaft 171 is installed to be supported by a bearing 178 installed in the developer container 111 in parallel with the developing roller 112, and a power transmission means 176 is provided at a side of the first shaft 171 positioned outside the developer container 111.

Preferably, but not necessarily, the power transmission means 176 is a gear. Thus, the gear is connected to a developing gear 177, and thus, the first shaft 171 also rotates when the developing roller 112 rotates.

In addition, the first shaft 171 may rotate with being connected to the developing roller 112 and another power transmission means such as a belt.

Meanwhile, as shown in FIG. 4, in a case where the developing roller 112 rotates, that is, only when a printing work is performed, the first shaft 171 connected to the developing roller 112 rotates. Thus, in a case where the printing work is not performed, the developing solution 118 is not shaken, and thus is deposited and may become solid.

Therefore, as shown in FIG. 5, the first shaft 171 may be connected to another motor 180 and rotate. In this case, the first shaft 171 may rotate and shake the developing solution 118 even though the developing roller 112 doesn't rotate.

A first gear 172 is provided to the first shaft 171 soaked in the developing solution 118. Although the first gear 172 is not formed in the entire first shaft 171 soaked in the developing solution 118 in FIGS. 4 and 5, the first gear 172 may be formed in the entire first shaft 171 as occasion demands. The length of the first gear 172 formed in the first shaft 171 depends on the number of the propeller 175, which is installed in consideration of the length of the propeller 175.

The second shaft 173 is perpendicular to the first shaft 171, and a second gear 174 is provided at a side of the second shaft 173 so as to engage with the first gear 171, and the propeller 175 for shaking the developing solution 118 is provided at another side of the second shaft 173.

Preferably, the rotative speed of the propeller 175 is slower than that of the cleaning roller 117. In a case where the rotative speed of the propeller 175 is faster than that of the cleaning roller 117, toner particles deposited at a downside of the developer container 111 are supplied between the developing roller 112 and the deposit roller 114 due to turbulent flow that occurs as the propeller 175 rotates. Because of this, the flow characteristics that the developing solution 118 is attached to the developing roller 112 due to a potential difference between the developing roller 112 and the deposit roller 114 may be disturbed. In addition, as the propeller 175 rotates, the level of the developing solution 118 stored in the developer container 111 may be increased.

Thus, the rotative speed of the propeller 175 is slower than that of the cleaning roller 117, and thereby the flow characteristics of the developing solution 118 between the developing roller 112 and the deposit roller 114 can be maintained, and an increase in the level of the developer container 111 can be prevented.

The operation of the agitator 170 having the above structure will be described below with reference to drawings.

Referring to FIGS. 3 and 4, the first shaft 171 connected to the developing gear 177 rotates when the developing roller 112 rotates. The second shaft 173 is rotated by the second gear 174 engaged with the first gear 172, and the propeller 175 also rotates.

The toner particles deposited at a downside of the developer container 111 are moved upward while the propeller 175 rotates, and the developing solution 118 stored in the developer container 111 is circulated upward and downward. Thus, the developing solution 118 in the developer container 111 is not deposited but may be kept in uniform concentration.

Referring to FIGS. 3 and 5, the first shaft 171 connected to the motor 180 also rotates when the motor 180 rotates. The operation of the propeller 175 is the same as the above description.

Only, even when the developing roller 112 doesn't rotate, the first shaft 171 is connected to the motor 180, and thus rotates. Thus, even when the printing work is not performed, the developing solution 118 is agitated, and thereby the developing solution 118 can be kept in uniform concentration.

As described above, the developer of the electrophotographic image forming system according to the preferred embodiment of the present invention can increase the efficiency of circulation of the developing solution by installing another agitator and by upward and downward circulating the developing solution with high concentration stored in the developer container, and can keep the developing solution in uniform concentration by preventing the developing solution with high concentration from being deposited at the bottom of the developer container.

While this invention has been particularly shown and described with reference to illustrative embodiments thereof, it will be understood by those skilled in the art that various changes in form and details may be made therein without departing from the spirit and scope of the invention as defined by the appended claims.

What is claimed is:

1. A developer of an electrophotographic image forming system, the developer comprising:

a developer container for storing a developing solution;

a developing roller disposed in said developer container, which is partially soaked in the developing solution that is stored in the developer container, said developing roller being installed to rotate in an opposite direction of a direction of rotation of a photosensitive medium; and a developing solution agitator which agitates the developing solution in an upward and downward direction for preventing accumulation of developing solution having a higher concentration at a bottom portion of the developer container and thereby maintaining the developing solution in a uniform concentration;

wherein the developing solution agitator comprises:

a first shaft, wherein said first shaft is installed to rotate in the developer container and wherein a first gear is disposed at a side of said first shaft;

at least one of a second shaft having a first side and a second side; wherein a second gear is disposed at the first side of the second shaft, and a propeller for agitating the developing solution, wherein said propeller is disposed at the second side of the second shaft.

2. The developer of claim 1, wherein the first shaft is in communication with the developing roller and wherein the developing roller rotates the first shaft.

3. The developer of claim 1, wherein a motor is connected to the first shaft and wherein said motor rotates the first shaft.

4. The developer of claim 1, wherein a rotative speed of the propeller is slower than a rotative speed of a cleaning roller.

5. A developer of an electrophotographic image forming system, the developer comprising:

a developer container for storing a developing solution;

a developing roller disposed in said developer container, which is partially soaked in the developing solution that is stored in the developer container, said developing roller being installed to rotate in an opposite direction of a direction of rotation of a photosensitive medium; and a developing solution agitator which agitates the developing solution in an upward and downward direction for preventing accumulation of developing solution having a higher concentration at a bottom portion of the developer container and thereby maintaining the developing solution in a uniform concentration;

wherein the developing solution agitator comprises:

a first shaft, wherein said first shaft is installed to rotate in the developer container and wherein a first gear is disposed at a side of said first shaft;

a second shaft having a first side and a second side; wherein a second gear is disposed at the first side of the second shaft; and a propeller for agitating the developing solution, wherein said propeller is disposed at the second side of the second shaft.

6. The developer of claim 5, wherein the first shaft is in communication with the developing roller and wherein the developing roller rotates the first shaft.

7. The developer of claim 5, wherein a motor is connected to the first shaft and wherein said motor rotates the first shaft.

8. The developer of claim 5, wherein a rotative speed of the propeller is slower than a rotative speed of a cleaning roller.

9. A developer of an electrophotographic image forming system, the developer comprising:

a developer container for storing a developing solution;

a developing roller which is partially soaked in the developing solution that is stored in the developer container, said developing roller being disposed within said developer container and installed to rotate in an opposite direction of a direction of a photosensitive medium; wherein the developing roller in the developing solution shakes the developing solution by rotating; and a developing solution agitator which agitates the developing solution in an upward and downward direction with respect to the developer container and thereby keeps the developing solution in a uniform concentration;

wherein the developing solution agitator comprises:

a first shaft, wherein said first shaft is installed to rotate in the developer container and wherein a first gear is disposed at a side of said first shaft;

a second shaft having a first side and a second side; wherein a second gear is disposed at the first side of the second shaft; and a propeller for agitating the developing solution in an upward and downward direction with respect to the developer container, wherein said propeller is disposed at the second side of the second shaft.

* * * * *